US010000919B2

(12) United States Patent
Oba et al.

(10) Patent No.: US 10,000,919 B2
(45) Date of Patent: Jun. 19, 2018

(54) CONNECTION STRUCTURE OF COLUMN AND BEAM AND METHOD FOR CONNECTING COLUMN AND BEAM

(71) Applicant: SENQCIA CORPORATION, Tokyo (JP)

(72) Inventors: Shuji Oba, Kumagaya (JP); Takashi Kitano, Kashiwa (JP); Michio Itoh, Kashiwa (JP)

(73) Assignee: SENQCIA CORPORATION, Tokyo (JP)

( * ) Notice: Subject to any disclaimer, the term of this patent is extended or adjusted under 35 U.S.C. 154(b) by 0 days. days.

(21) Appl. No.: 15/266,479

(22) Filed: Sep. 15, 2016

(65) Prior Publication Data

US 2018/0002913 A1 Jan. 4, 2018

(30) Foreign Application Priority Data

Jul. 1, 2016 (JP) ..... 2016-131286

(51) Int. Cl.
*E04B 1/24* (2006.01)

(52) U.S. Cl.
CPC .... *E04B 1/2403* (2013.01); *E04B 2001/2415* (2013.01); *E04B 2001/2418* (2013.01); *E04B 2001/2451* (2013.01); *E04B 2001/2466* (2013.01); *E04B 2103/06* (2013.01)

(58) Field of Classification Search
CPC ..... E04B 1/2403; E04B 2001/2451; E04B 2001/2415; E04B 2001/2466; E04B 2001/2418; E04B 2103/06
See application file for complete search history.

(56) References Cited

U.S. PATENT DOCUMENTS 1,744,600 A * 1/1930 Wilcox ..... E04B 1/2403 403/230
3,716,957 A * 2/1973 Bernardi ..... E04B 1/5812 52/633
3,716,959 A * 2/1973 Bernardi ..... E04B 1/2403 52/837
3,938,297 A * 2/1976 Sato ..... E04B 1/2403 403/188
3,977,801 A * 8/1976 Murphy ..... E04B 1/2403 248/188

(Continued)

FOREIGN PATENT DOCUMENTS

JP 03262840 A * 11/1991
JP 05133005 A * 5/1993

(Continued)

*Primary Examiner* — Brent W Herring
(74) *Attorney, Agent, or Firm* — Oliff PLC

(57) ABSTRACT

A pair of outer diaphragms (3*a*), (3*b*) is connected to a column (5). The outer diaphragms (3*a*) and (3*b*) include female screws (15) formed in a direction so as to be put between an end plate (13*a*) and the column (5). The end plate (13*a*) is connected by welding to the end faces of an upper flange part (11*a*), a lower flange part (11*b*), and the web of a beam (9*a*). On upper and lower projecting parts of the end plate (13*a*), bolt holes 17 are formed at the positions that correspond to the female screws (15) of the outer diaphragms (3*a*) and (3*b*). The bolts (7), which are in a direction parallel to the longitudinal direction of the beam (9*a*), connect the end plate (13*a*) to the outer diaphragms (3*a*) and (3*b*).

8 Claims, 13 Drawing Sheets

(56) References Cited

U.S. PATENT DOCUMENTS 4,023,684 A * 5/1977 Saul ..... A47F 5/10 211/193
4,047,341 A * 9/1977 Bernardi ..... E04B 1/2403 403/230
4,054,392 A * 10/1977 Oppenheim ..... F16B 7/18 403/175
4,577,449 A * 3/1986 Celli ..... E04B 1/2403 182/186.8
5,403,110 A * 4/1995 Sammann ..... E04B 1/5831 403/205
5,600,924 A * 2/1997 Forsberg ..... E04B 1/24 52/276
5,680,738 A * 10/1997 Allen ..... E04B 1/2403 52/653.1
6,059,482 A * 5/2000 Beauvoir ..... E04B 1/2403 403/187
6,219,989 B1 * 4/2001 Tumura ..... E04B 1/2403 52/274
6,474,902 B1 * 11/2002 Beauvoir ..... E04B 1/2403 403/187
6,516,583 B1 * 2/2003 Houghton ..... E04B 1/24 52/167.3
6,739,099 B2 * 5/2004 Takeuchi ..... E04B 1/2403 403/403
6,837,016 B2 * 1/2005 Simmons ..... E04B 1/2403 403/173
7,021,020 B2 * 4/2006 Simmons ..... E04B 1/2403 52/653.2
7,051,917 B2 * 5/2006 Simmons ..... B23K 1/012 228/165
7,127,863 B2 * 10/2006 Simmons ..... E04B 1/2403 52/838
7,155,874 B2 * 1/2007 Lee ..... E04B 1/24 52/843
7,497,054 B2 * 3/2009 Takeuchi ..... E04B 1/2403 403/403
7,637,076 B2 * 12/2009 Vaughn ..... E02D 27/34 403/169
7,647,742 B2 * 1/2010 Han ..... E04B 1/24 52/236.5
7,762,038 B2 * 7/2010 Ceba ..... E04B 1/2403 52/653.1
7,874,120 B2 * 1/2011 Ohata ..... E04B 1/2403 52/653.1
8,375,652 B2 * 2/2013 Hiriyur ..... E04B 1/2403 403/2
8,919,072 B2 * 12/2014 Han ..... E04B 1/34 52/649.3
9,249,593 B2 * 2/2016 Perko ..... E04H 9/145
9,334,642 B1 * 5/2016 Tanaka ..... E04B 1/2403
9,394,679 B2 * 7/2016 Tanaka ..... E04B 1/2403
9,476,218 B2 * 10/2016 Takahashi ..... E02D 27/42
2002/0184836 A1 * 12/2002 Takeuchi ..... E04B 1/2403 52/167.1
2003/0041549 A1 * 3/2003 Simmons ..... E04B 1/2403 52/655.1
2004/0093825 A1 * 5/2004 Lee ..... E04B 1/24 52/843
2004/0139683 A1 * 7/2004 Simmons ..... E04B 1/2403 52/719
2004/0187430 A1 * 9/2004 Takeuchi ..... E04B 1/2403 52/837
2004/0244330 A1 * 12/2004 Takeuchi ..... E04B 1/2403 52/831
2005/0066612 A1 * 3/2005 Simmons ..... E04B 1/2403 52/633
2005/0072108 A1 * 4/2005 Simmons ..... E04B 1/2403 52/835
2006/0144006 A1 * 7/2006 Suzuki ..... E04B 1/2403 52/655.1
2006/0265992 A1 * 11/2006 Hiragaki ..... E04B 1/2403 52/633
2007/0163204 A1 * 7/2007 Ceba ..... E04B 1/2403 52/741.1
2007/0209314 A1 * 9/2007 Vaughn ..... E02D 27/34 52/838
2007/0261356 A1 * 11/2007 Vaughn ..... E02D 27/34 52/655.1
2008/0213040 A1 * 9/2008 Morze-Reichartz .. E04B 1/2604 403/381
2012/0304587 A1 * 12/2012 Kenho ..... E04H 9/021 52/699
2014/0083042 A1 * 3/2014 Hiragaki ..... F16B 7/182 52/655.1
2014/0115979 A1 * 5/2014 Kenho ..... E04H 9/021 52/167.7
2014/0338280 A1 * 11/2014 Tanaka ..... E04B 1/2403 52/655.1
2015/0191929 A1 * 7/2015 Takahashi ..... E02D 27/42 52/295

FOREIGN PATENT DOCUMENTS

JP 06167049 A * 6/1994
JP 2001-329613 A 11/2001
JP 2015-224460 A 12/2015

* cited by examiner

CONNECTION STRUCTURE OF COLUMN AND BEAM AND METHOD FOR CONNECTING COLUMN AND BEAM

TECHNICAL FIELD OF THE INVENTION

This invention relates to a connection structure, and the like, of a column and a beam in which a beam is connected to a steel-pipe column.

BACKGROUND OF THE INVENTION

In conventional constructions using steel-pipe columns, there are cases in which beams made of H-shaped steel are connected. For connecting columns and beams, through diaphragms or inner diaphragms, which suit the height of the flange parts of the beams, are provided to transfer stress from the beams to the columns efficiently at their connection parts. A through diaphragm is a plate-like member that is connected between two columns by welding, whereas an inner diaphragm is a plate-like member that is connected inside the column by welding. Through diaphragms or inner diaphragms are usually connected in advance in factories.

As such a column-beam connecting structure, Patent Document 1 discloses a column-beam connection structure in which a column-beam connecting metal fitting is welded to a column. The metal fitting has a flat surface for at least an area of a peripheral face of the column that is to be connected with a beam, and a beam made of H-shaped steel is connected to a peripheral face of the column-beam connecting metal fitting by non-scallop welding.

Alternatively, there is a method in which outer diaphragms, which are connected to the outer faces of a column, are used (Patent Document 2, for example).

RELATED ART

Patent Documents

[Patent Document 1] Japanese Unexamined Patent Application Publication No. 2001-329613 (JP-A-2001-329613)
[Patent Document 2] Japanese Unexamined Patent Application Publication No. 2015-224460 (JP-A-2015-224460)

SUMMARY OF THE INVENTION

Problems to be Solved by the Invention

However, work of providing an inner diaphragm inside a column requires too much welding, resulting in bad workability. In addition, the structure described in Patent Document 1 requires integrally formed column-beam connection parts, increasing the mass and the cost of metallic materials.

Meanwhile, although outer diaphragms enable work outside the column, the structure described in Patent Document 2 has a problem that the structure of its connecting parts is complicated and large-sized. In addition, the size of the outer diaphragm is large, and thus transportation of a column joined with the outer diaphragms from the factory is difficult.

The present invention was achieved in view of such problems. Its object is to provide a connection structure of a column and a beam, which is a simple structure that requires work only outside of the column, without connecting members such as diaphragms inside the column or using column-beam connecting metal fittings having special structures.

Means for Solving Problems

To achieve the above object, a first invention is a connection structure for a column and a beam including outer diaphragms that are connected to outer faces of the column at different heights and a first beam of which an end face is connected with a first end plate. On the outer diaphragms, female screws are formed in a direction so as to be put between the first end plate and the column. On the first end plate, bolt holes are formed at positions that correspond to the female screws on the outer diaphragms, and bolts in a direction parallel to a longitudinal direction of the first beam connect the first end plate with the outer diaphragms.

The outer diaphragm may be divided into a plurality of sections in a perimeter direction and each of the divided sections of the outer diaphragms may be connected to outer faces of the column, extending over at least two faces of the column.

The divided sections of the outer diaphragms may be connected to the column with gaps between the sections.

The connection structure for a column and a beam may include a second beam, which has a different height from that of the first beam and is connected to the column in a different direction from the direction of the first beam. A second end plate may be connected to an end face of the second beam and the second end plate is taller than the second beam. Both end parts of the second end plate project upward and downward from both flange faces of the second beam, and bolt holes are formed on the projecting parts of the second end plate at positions that correspond to the female screws on the outer diaphragms. Bolts in a direction parallel to a longitudinal direction of the second beam may connect the second end plate with the outer diaphragms.

The first end plate may be taller than the first beam, both end parts of the first end plate may project upward and downward from both flange faces of the first beam, and the bolt holes may be formed on the projecting parts of the first end plate.

According to the first invention, outer diaphragms are connected to outer faces of a column, and thus work can be done only outside of the column and is easy compared to the cases using inner diaphragms or through diaphragms. In addition, an end plate and outer diaphragms are connected by using bolts that are in a direction parallel to the longitudinal direction of a beam, and thus a thickness only as thick as the connection margin for the bolts is required for the outer diaphragms. For this reason, a compact, simple, and easy-to-work connection for a column and a beam can be obtained without using column-beam connecting metal fittings having special structures.

In addition, if the outer diaphragms are divided into a plurality of sections in the peripheral direction, connecting the outer diaphragms to the column becomes easy. In addition, connecting the divided outer diaphragms extending over at least two faces can transfer stress from the beam to the column with certainty.

In addition, the sections of the divided outer diaphragms are connected to the periphery of the column with gaps between each other so as to prevent creating gaps and the like between outer diaphragms and the column due to processing accuracy and the like of the column or the outer diaphragms.

In addition, if beams with different heights are connected, end plates that correspond to the heights of the beam are used and each of the end plates is connected to the corresponding part of the outer diaphragms. In this way, the present invention can be adapted with a simple structure for beams having different heights.

In addition, making the first end plate taller than the first beam and forming bolt holes on the projecting parts of the first end plate allow the bolts to be arranged without interfering the web of the first beam.

A second invention is a method for connecting a column and a beam using outer diaphragms and a beam of which an end face is connected with an end plate in advance. On the outer diaphragms, female screws are formed in a direction so as to be put between the first end plate and the column. The end plate is taller than the beam, both end parts of the end plate project upward and downward from both flange faces of the beam, and bolt holes are formed on the projecting parts of the end plate at positions that correspond to the female screws on the outer diaphragms. The outer diaphragms are connected to outer faces of the column at different heights and bolts are inserted into the bolt holes and the female screws in a direction parallel to a longitudinal direction of the beam to connect the end plate and the outer diaphragms.

According to the second invention, a method for connecting a column and a beam, which can be operated easily at a site, can be obtained.

Effects of the Invention

The present invention can provide a connection structure of a column and a beam, which is a simple structure that requires work only outside of the column, without connecting members such as diaphragms inside the column or using column-beam connecting metal fittings having special structures.

DESCRIPTION OF SOME EMBODIMENTS

Figure 1:
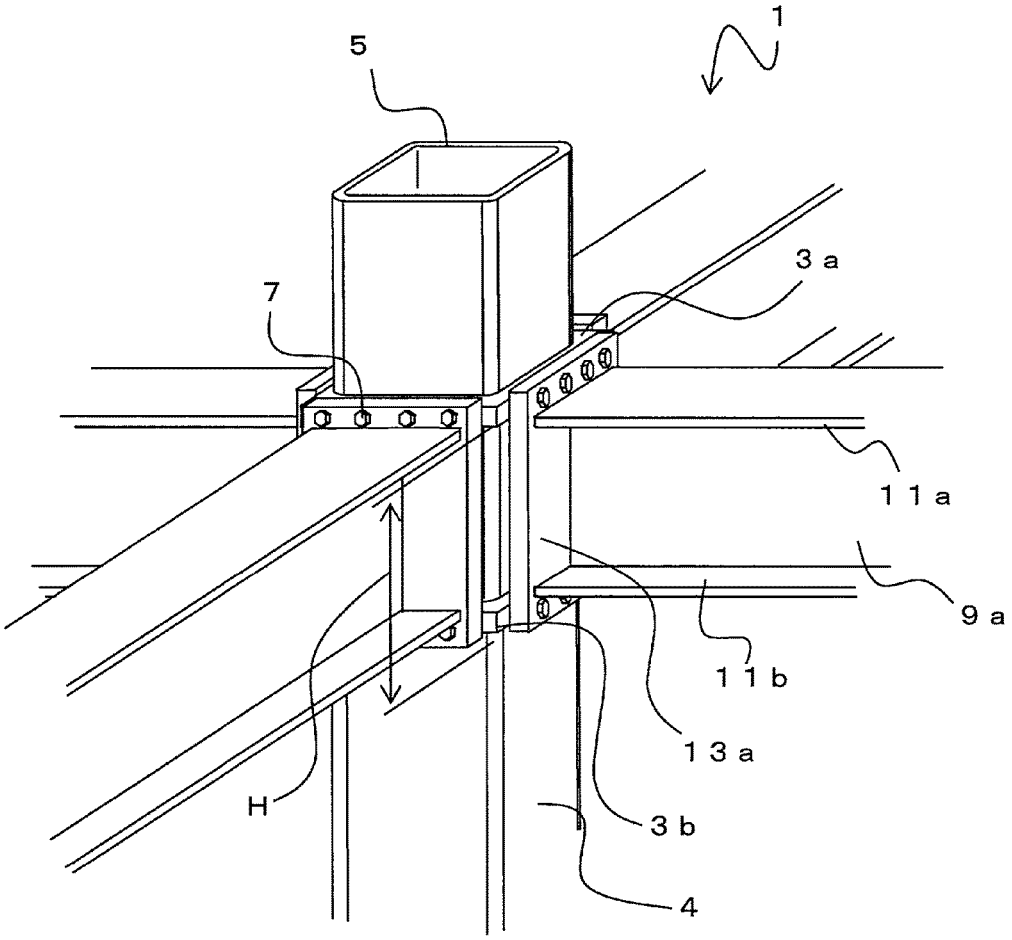
FIG. 1 is a perspective view showing a connection structure 1 of a column and a beam.
Figure 2:
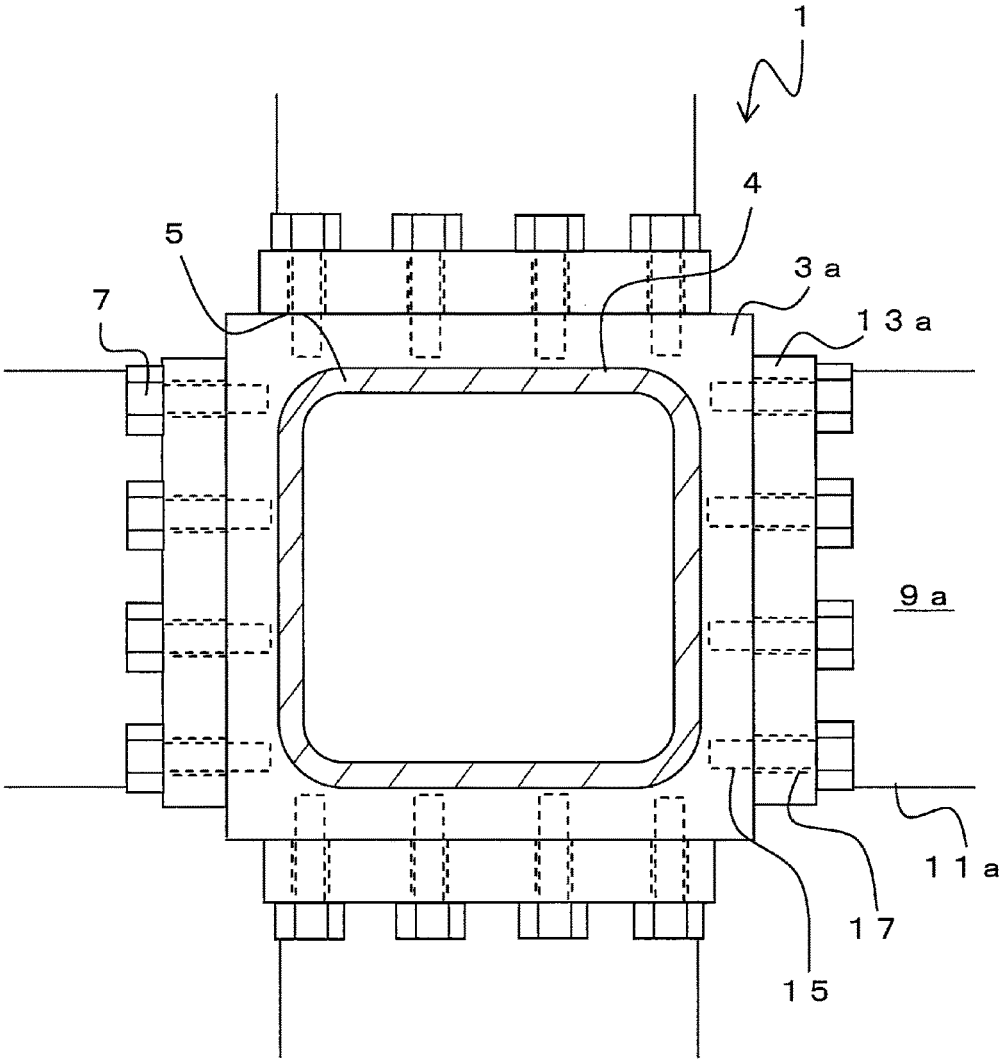
FIG. 2 is a plan view showing a connection structure 1 of a column and a beam.

Hereinafter, a connection structure 1 of a column and a beam according to an embodiment of the present invention will be described. FIG. 1 is a perspective view and FIG. 2 is a plan view (a cross sectional view of a column 5) showing the connection structure 1 of a column and a beam. The connection structure 1 of a column and a beam includes the column 5 connected with a plurality of beams 9*a*.

The column 5 is a hollow square steel-piped column and the beam 9*a*, which is a first beam, is H-shaped steel. Although the example shown in the drawings has the column 5 of which the four faces are connected with the beams 9*a* of the same height in four directions respectively, the beams 9*a* may be connected only in two or three directions.

A pair of outer diaphragms 3*a* and 3*b* is connected to the column 5. The outer diaphragms 3*a* and 3*b* are connected to the outer faces 4 of the column 5. The outer diaphragms 3*a* and 3*b* are provided at different heights H of the column 5 with a predetermined interval. The outer diaphragms 3*a* and 3*b* include female screws 15 formed in the direction so as to be put between the first end plate and the column (see FIG. 2).

An end plate 13*a*, which is a first end plate, is connected by welding to the end faces of an upper flange part 11*a*, a lower flange part 11*b*, and the web of the beam 9*a*. The height of the end plate 13*a* is larger than the height of the beam 9*a*. Thus, both upper and lower end parts of the end plate 13*a* project upward and downward from the upper and lower faces of the flange parts 11*a* and 11*b* of the beam 9*a*, respectively. On the projecting parts of the end plate 13*a*, bolt holes 17 are formed at the positions that correspond to the female screws 15 of the outer diaphragms 3*a* and 3*b*. The bolt hole 17 is a hole larger than the female screw 15. A plurality of the bolt holes 17 are arranged in a row at each of the upper and lower parts.

The bolt holes 17 and the female screws 15 are arranged substantially at the same position, which enables to insert bolts 7 into the bolt holes 17 and the female screws 15 in a direction parallel to the longitudinal direction of the beam 9*a*. Thus, the bolts 7 can connect the end plate 13*a* to the outer diaphragms 3*a* and 3*b* in a direction parallel to the longitudinal direction of the beam 9*a*.

As a method for connecting a column and a beam, first, the beam 9*a* and the end plate 13*a* are connected in advance in the factory for example. The outer diaphragms 3*a* and 3*b* may be connected to the outer faces 4 of the column at different heights H in advance in, for example, the factory or may be connected at the construction site. In either case, the outer shape of the column 5 is never too large, which makes transportation and the like easy. The connection of the column and the beam can be achieved at the construction site by inserting bolts 7 into the bolt holes 17 and the female screws 15 in a direction parallel to the longitudinal direction of the beam 9*a*, connecting the end plate 13*a* and the outer diaphragms 3*a* and 3*b*.

According to the above first embodiment, a connection structure 1 of a column and a beam, which is a simple structure that requires work only outside of the column 5, without connecting members such as inner diaphragms inside the column or using column-beam connecting metal fittings having special structures, can be obtained. Here, if the outer diaphragms 3*a* and 3*b* are connected to the column 5 in advance, the connection of the column and the beam can be completed using the bolts 7 alone, facilitating the work at construction site. In addition, the outer diaphragms 3*a* and 3*b* are connected with the end plate 13*a* by the bolts 7 and thus the stress from the beam 9*a* can be transferred to the column 5 with certainty.

Figure 3:
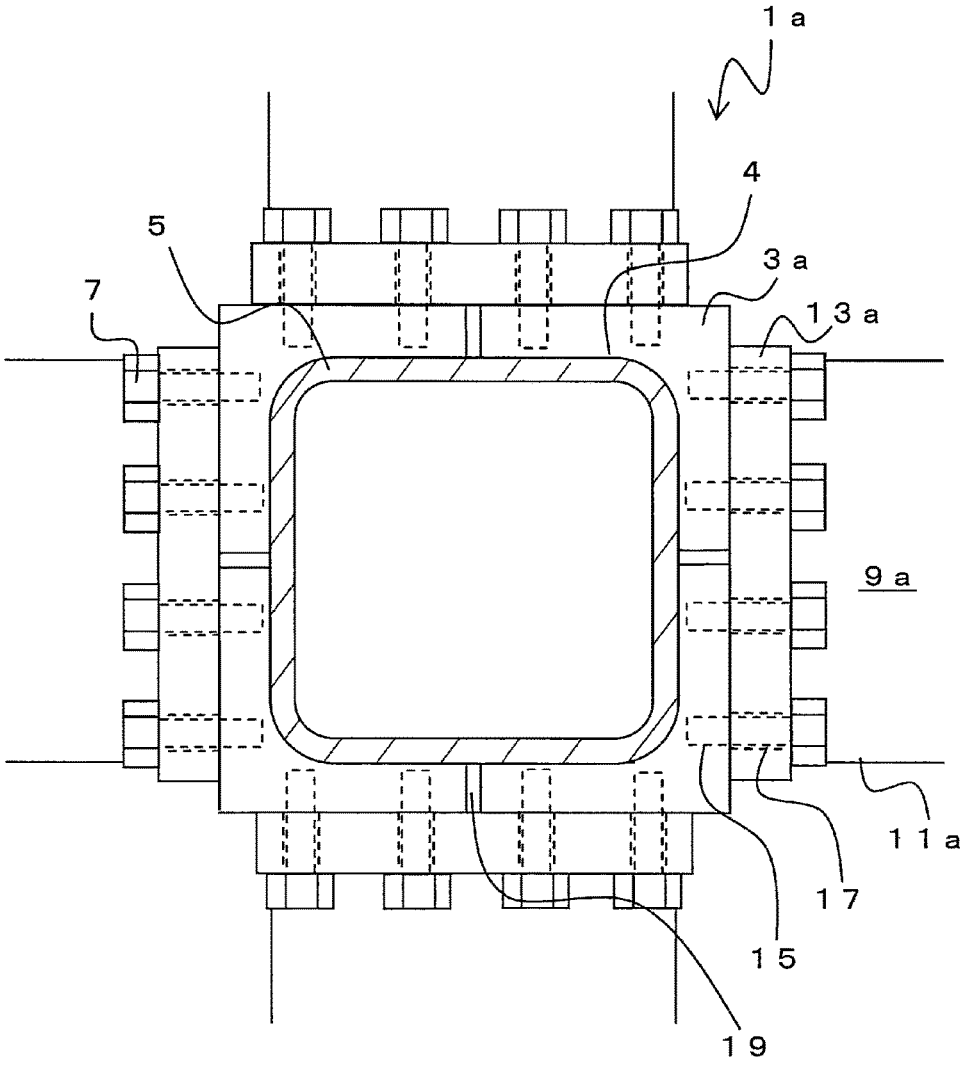
FIG. 3 is a plan view showing a connection structure 1*a* of a column and a beam.

Next, a second embodiment will be described. FIG. 3 is a plan view showing the connection structure 1*a* of a column and a beam (a cross sectional view of the column 5). In the descriptions below, the same notations as in FIG. 1 and FIG. 2 will be used for the structures having the same functions as the connection structure 1 of a column and a beam, and redundant descriptions will be omitted.

The connection structure 1*a* of a column and a beam is approximately the same as the connection structure 1 of a column and a beam except that the outer diaphragms 3*a* and 3*b* are divided into a plurality of sections in the perimeter direction. In the example shown in the drawing, the outer diaphragm 3*a* is divided at the substantially center of the width direction of each face of the column 5 into four sections in the perimeter direction. This is same for the outer diaphragm 3*b*. Each of the divided sections of the outer diaphragm 3*a* is connected to outer faces of the column 5, extending over at least two faces of the column 5.

On this occasion, a gap 19 is formed between the outer diaphragms 3*a*. This can prevent the outer diaphragms 3*a* from butting to each other and creating gaps and the like between the column 5 and the outer diaphragms 3*a* depending on processing accuracy of the column 5 or the outer diaphragms 3*a*, so that the outer diaphragms 3*a* can be connected to the column 5 efficiently.

Figure 4:
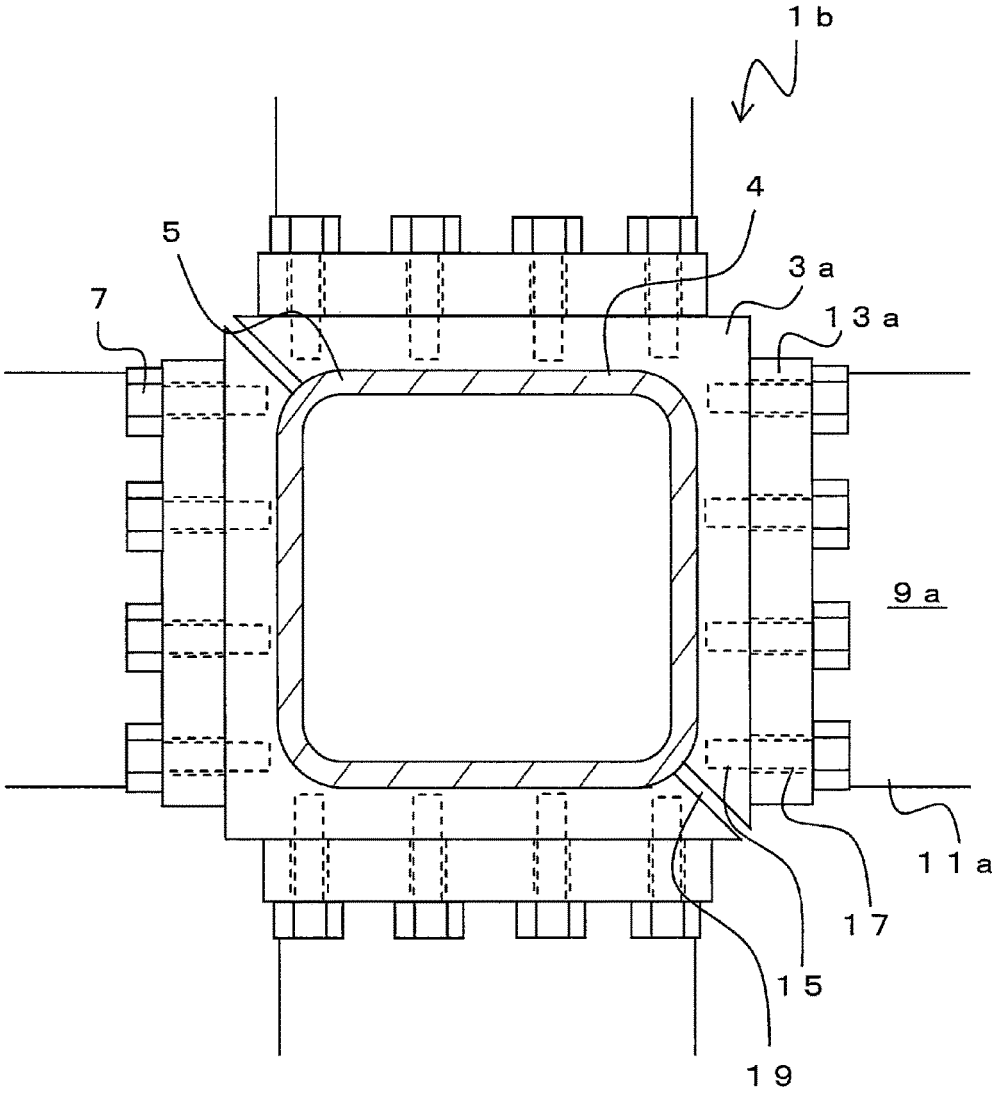
FIG. 4 is a plan view showing a connection structure 1*b* of a column and a beam.

When the outer diaphragm 3*a* is divided in the perimeter direction, stress can still be efficiently transferred from the beam 9*a* to the column 5 by providing the outer diaphragm 3*a* in a bending shape, such as in L-shape, extending over at least two faces of the column 5. If the outer diaphragm 3*a* can be divided so as to extend over at least two faces of the column 5 as above, a pair of corner parts facing each other diagonally may also be the dividing parts as in a connection structure 1*b* of a column and a beam shown in FIG. 4, for example.

Figure 5:
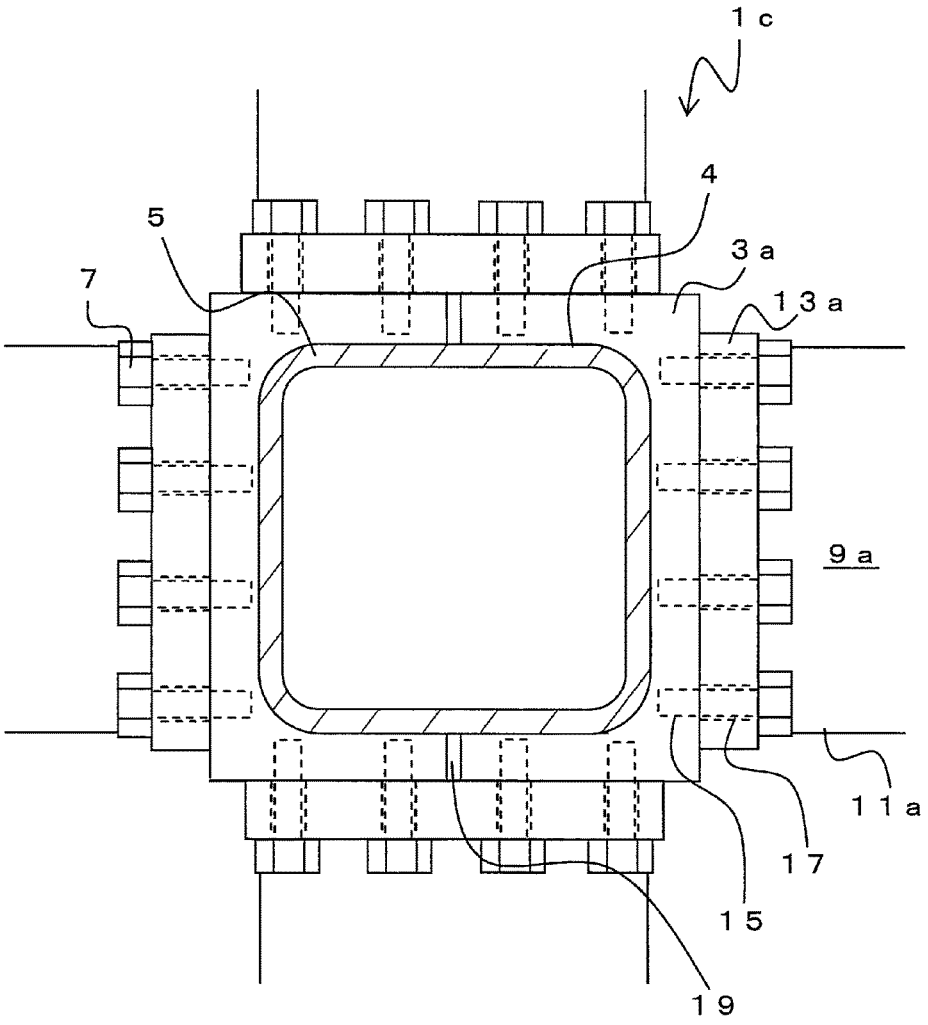
FIG. 5 is a plan view showing a connection structure 1*c* of a column and a beam.

Alternatively, as in a connection structure 1*c* of a column and a beam shown in FIG. 5, the outer diaphragm 3*a* can be divided at the substantially center of the width direction of a pair of opposing faces of the column 5 so as to be divided into two sections in the perimeter direction. This also allows efficient stress transfer from the beam 9*a* to the column 5 by providing the outer diaphragm 3*a* in a bending shape, such as in U-shape, extending over at least two faces (three faces in the present embodiment) of the column 5.

Figure 6:
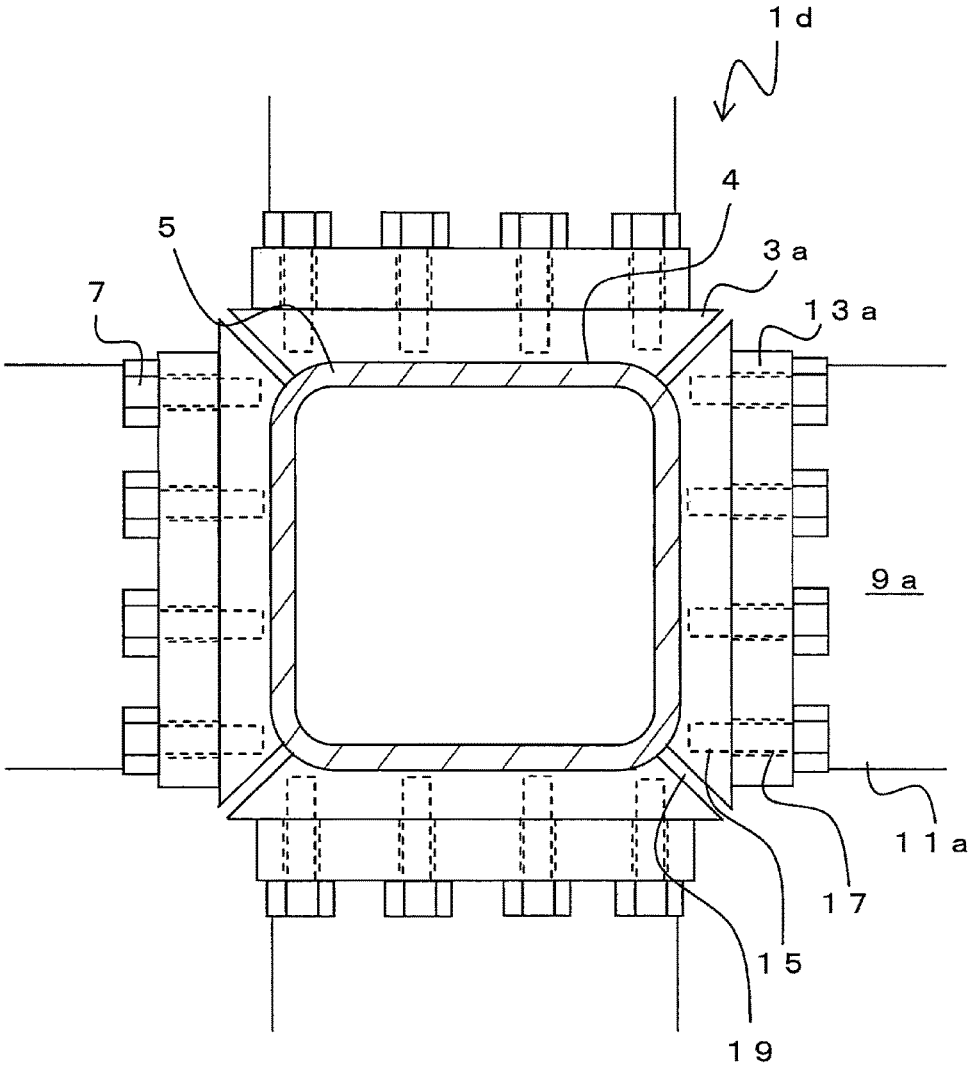
FIG. 6 is a plan view showing a connection structure 1*d* of a column and a beam.

If the stress transfer is sufficient, it is unnecessary to arrange the outer diaphragm 3*a* to extend over two faces of the column 5 as in a connection structure 1*d* of a column and a beam shown in FIG. 6. For example, two pairs of the corner parts facing to each other diagonally can all be the dividing parts.

According to the second embodiment, the same effects as in the first embodiment can be obtained. In addition, dividing the outer diaphragms 3*a* and 3*b* facilitates connecting the outer diaphragms 3*a* and 3*b* to the column 5.

Figure 7:
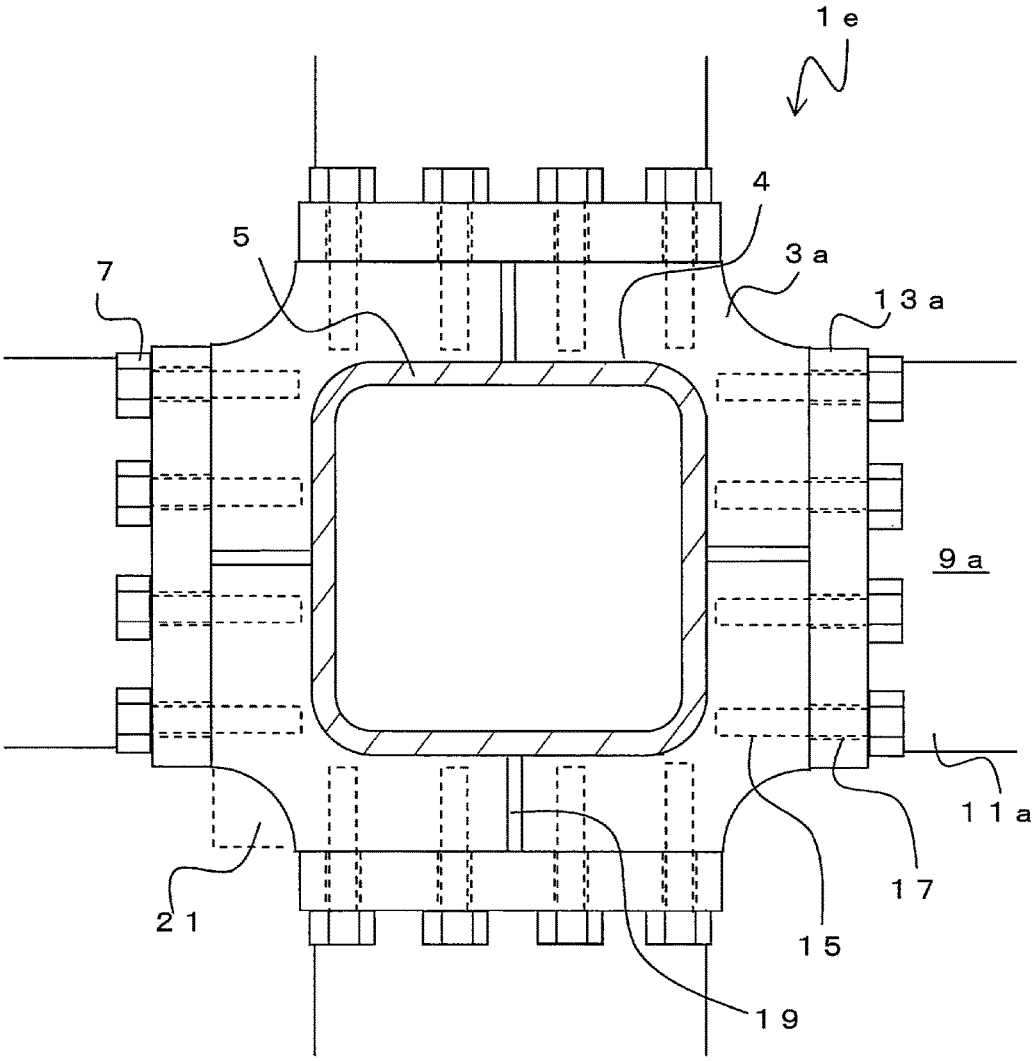
FIG. 7 is a plan view showing a connection structure 1*e* of a column and a beam.

Next, a third embodiment will be described. FIG. 7 is a plan view showing a connection structure 1*e* of a column and a beam. In the embodiments below, although examples in which the outer diaphragm 3*a* is divided into four sections are shown, other embodiments can also be adapted.

The connection structure 1*e* of a column and a beam is the same as the connection structure 1*a* of the column and a beam except that the thickness of the outer diaphragms 3*a* and 3*b* is large and a cutout 21 is formed at each corner part. That is, although the outer diaphragms 3*a* and 3*b* are substantially rectangular shaped as a whole, the corners of the corner parts have cutouts in the present embodiment.

Increasing the thickness of the outer diaphragms 3*a* and 3*b* can increase the depth of the female screws 15. Thus, the length of screwing of the bolts 7 can be increased. As a result, the connection strength between the bolts 7 and the outer diaphragms 3*a* and 3*b* can be enhanced.

In addition, although the thickness of the outer diaphragms 3*a* and 3*b* is increased, forming the cutouts 21 can prevent increase in weight of the outer diaphragms 3*a* and 3*b* and can also prevent raise in material costs. At this time, the corner parts of the outer diaphragms 3*a* and 3*b* hardly contribute to the stress transfer, and forming of the cutouts 21 has no influence on impairing the stress transfer from the beam 9*a* to the column 5.

According to the third embodiment, the same effects as in the first embodiment can be obtained. In addition, the thick outer diaphragms 3*a* and 3*b* enable to improve the connection strength between the beam 9*a* and the column 5, as well as making the outer diaphragms 3*a* and 3*b* in the most suitable shape design.

Figure 8:
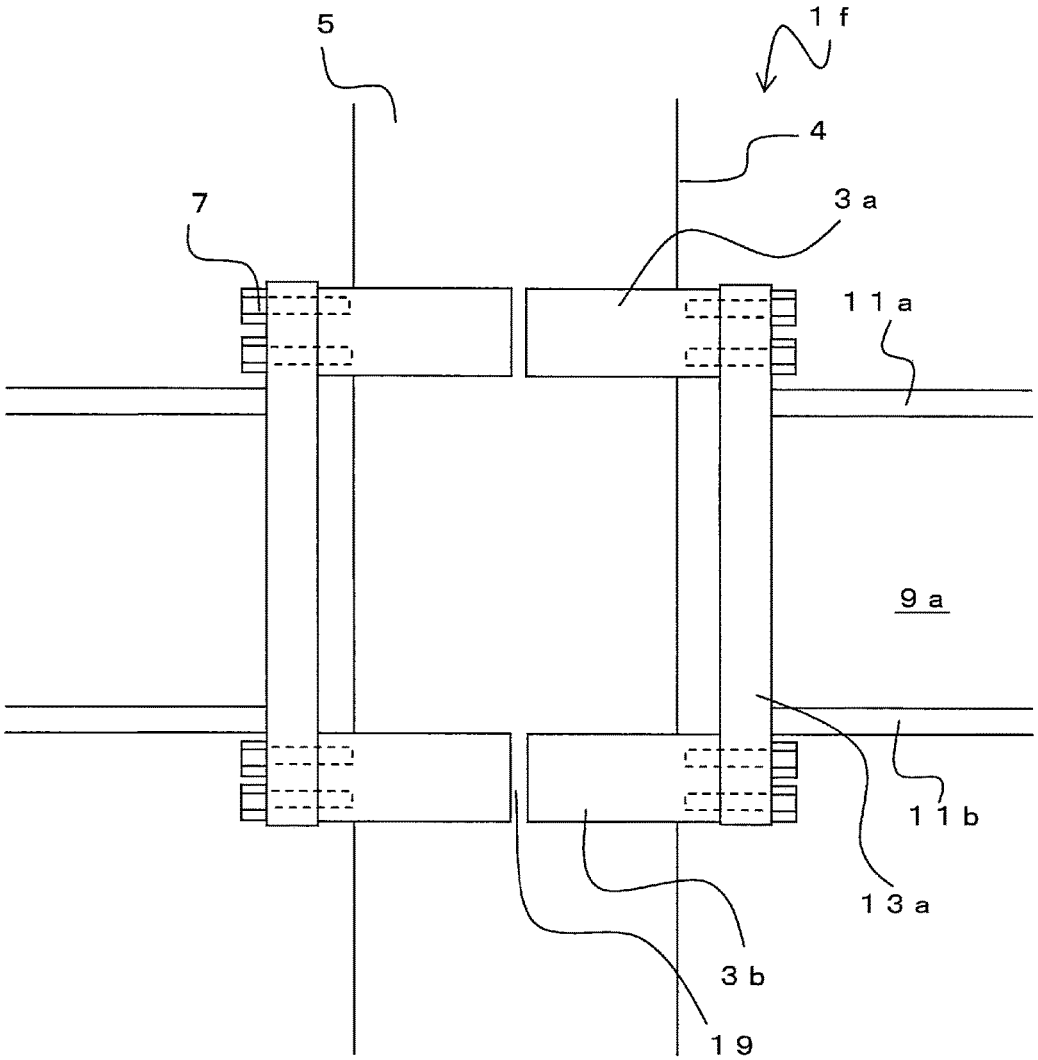
FIG. 8 is a side view showing a connection structure 1*f* of a column and a beam.

Next, a fourth embodiment will be described. FIG. 8 is a side view showing a connection structure 1*f* of a column and a beam. The example shown in the drawing shows the state in which the beams 9*a* are connected in two opposing directions.

The connection structure 1*f* of a column and a beam is approximately the same as the connection structure 1*a* of a column and a beam except that the amount of projection of the end plate 13*a* from the upper and lower flange parts 11*a* and 11*b* of the beam 9*a* is large. That is, the total height of the end plate 13*a* is larger.

In addition, similarly, each height of the outer diaphragms 3*a* and 3*b* is larger in proportion to the end plate 13*a*. Increase in the amount of projection of the end plate 13*a* from the upper and lower face of the beam 9*a* as well as increase in the heights of the outer diaphragms 3*a* and 3*b* allow the female screws 15 and the bolt holes 17 to be arranged in two rows at above and below the flange parts 11*a* and 11*b*, respectively. That is, a plurality of rows of the bolts 7 can connect the end plate 13*a* with the diaphragms 3*a* and 3*b* above and below the beam 9*a*.

Figure 9:
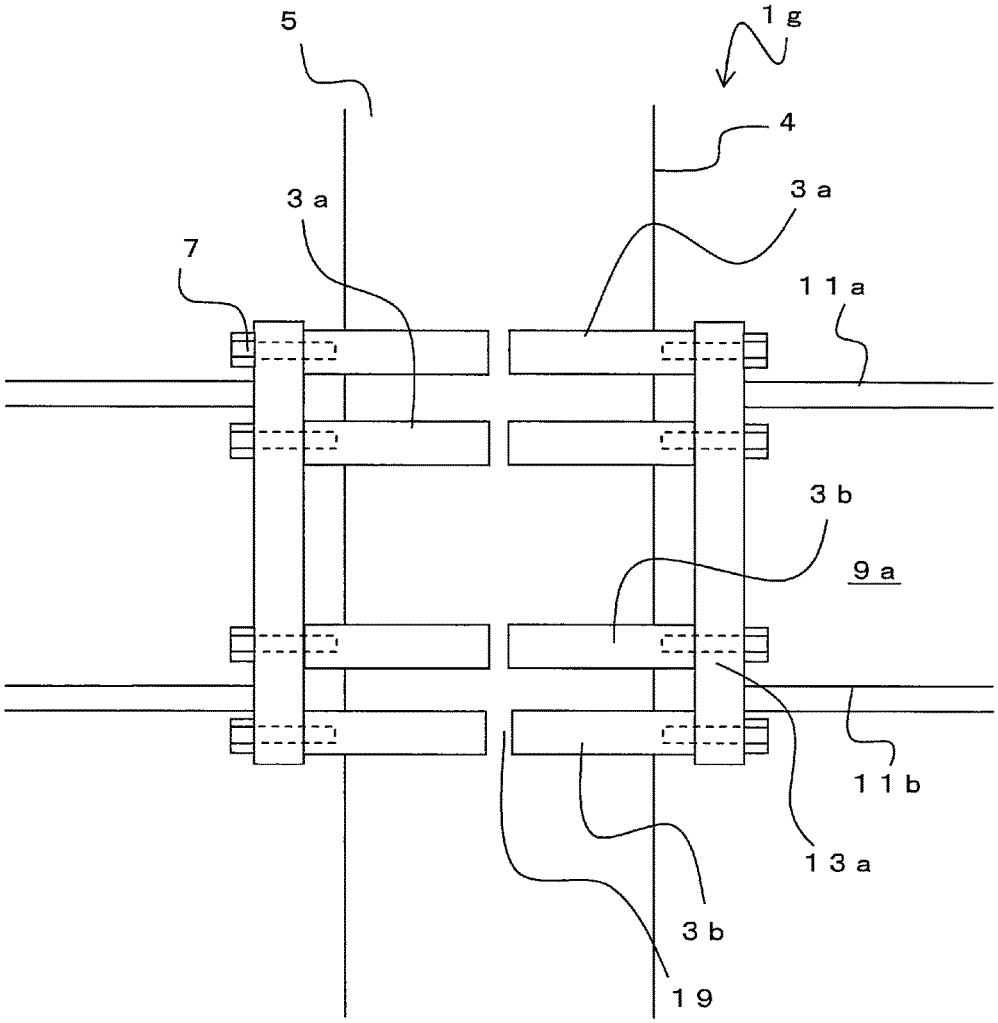
FIG. 9 is a side view showing a connection structure 1*g* of a column and a beam.

The way of connecting the end plate 13*a* with the outer diaphragm 3*a* and 3*b* above and below the beam 9*a* using a plurality of rows of bolts 7 is not limited to the example shown in FIG. 8. For example, as in the connection structure 1*g* of a column and a beam shown in FIG. 9, a pair of the outer diaphragms 3*a* may be arranged so as to straddle over above and below the flange part 11*a*, and a pair of the outer diaphragms 3*b* may be arranged so as to straddle over above and below the flange part 11*b*.

As for the outer diaphragm 3*a* that is arranged below the flange part 11*a*, the bolts 7 are arranged so as not to interfere with the web of the beam 9*a*. Similarly, as for the outer diaphragm 3*b* that is arranged above the flange part 11*b*, the bolts 7 are arranged so as not to interfere with the web of the beam 9*a*.

As above, arranging a plurality of rows of the outer diaphragms 3*a* and 3*b* straddling over the flange parts 11*a* and 11*b* respectively and connecting each of the outer diaphragms 3*a* and 3*b* to the end plate 13*a* and the beam 9*a* can efficiently improve the connection strength between the beam 9*a* and the column 5. In addition, in this way, there is no need to excessively increase the size of the end plate.

Figure 10:
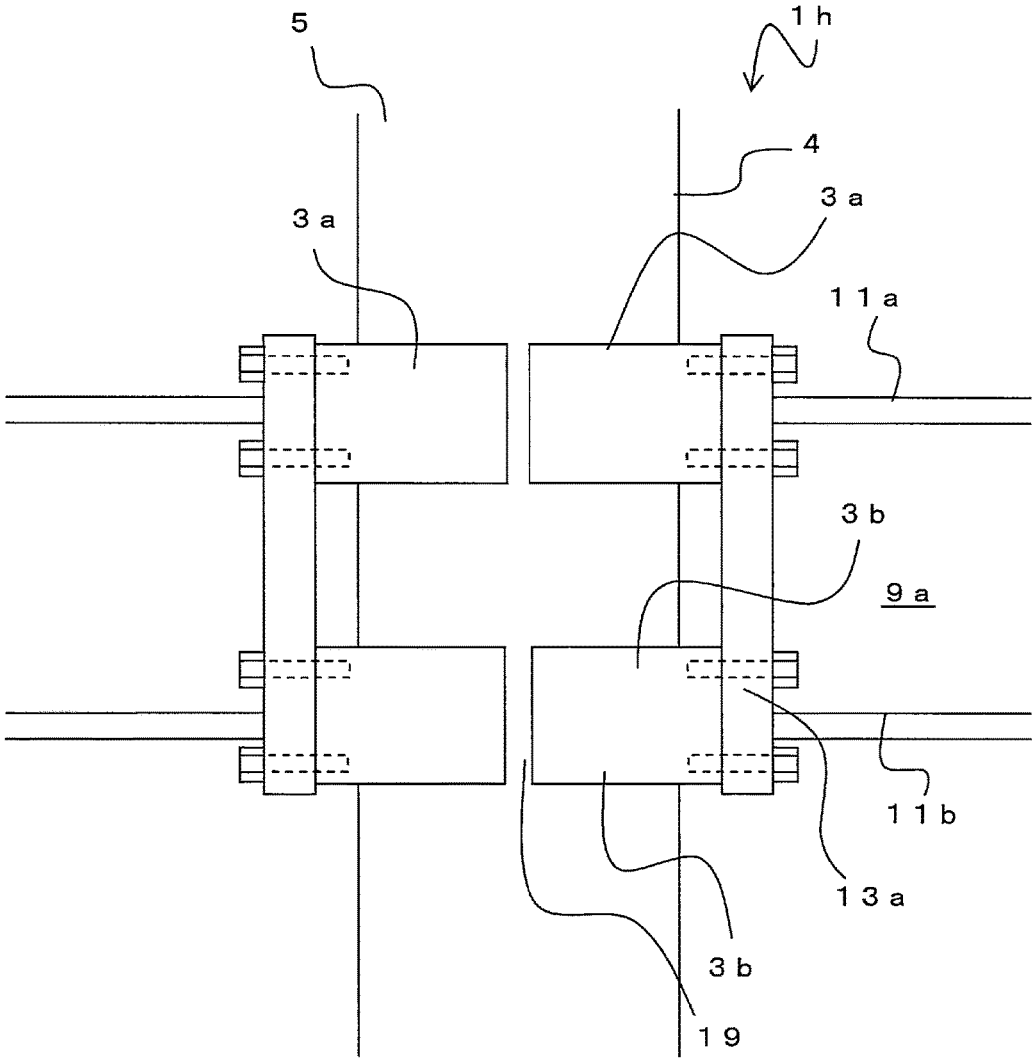
FIG. 10 is a side view showing a connection structure 1*h* of a column and a beam.

Similar effects can also be obtained from a connection structure 1*h* of a column and a beam shown in FIG. 10, in which the tall outer diaphragm 3*a* is arranged so as to straddle over above and below the flange part 11*a* and the tall outer diaphragm 3*b* is arranged so as to straddle over above and below the flange part 11*b*. That is, each of the pair of upper and lower outer diaphragms 3*a* and 3*b* of the connection structure 1*g* for a column and a beam shown in FIG. 9 may be integrated. As above, arranging the outer diaphragms 3*a* and 3*b* straddle over above and below the flange parts 11*a* and 11*b* respectively and connecting each of the outer diaphragms 3*a* and 3*b* to the end plate 13*a* above and below the flange parts 11*a* and 11*b* in a plurality of rows respectively can improve the connection strength between the beam 9*a* and the column 5.

According to the fourth embodiment, the same effects as in the first embodiment can be obtained. In addition, the connection strength between the beam 9*a* and the column 5 can be improved because the number of bolts 7 can be increased.

Figure 11:
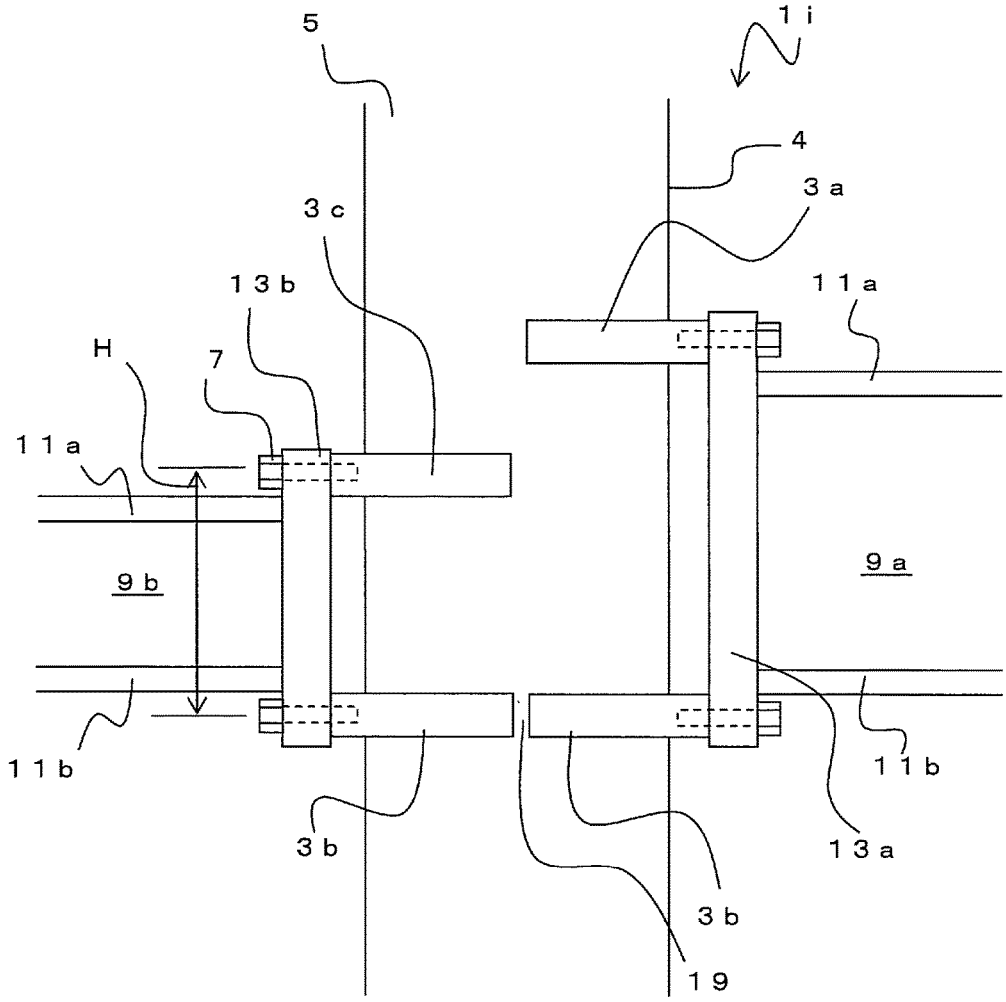
FIG. 11 is a side view showing a connection structure 1*i* of a column and a beam.

Next, a fifth embodiment will be described. FIG. 11 is a side view showing a connection structure 1*i* of a column and a beam. The connection structure 1*i* of a column and a beam includes the beam 9*a* and a beam 9*b* that are connected to the column 5. The beam 9*b*, which is a second beam, has a different height from that of the beam 9*a*. In addition, the beam 9*b* is connected to the column 5 in a direction different from the direction of the beam 9*a*. In the example shown in the drawing, the beams 9*a* and 9*b* are connected in two opposing directions.

To the upper and lower flange parts 11*a* and 11*b* and the end face of the web of the beam 9*b*, an end plate 13*b*, which is a second end plate, is connected by welding. The height of the end plate 13*b* is taller than the height of the beam 9*b*. Thus, both upper and lower end parts of the end plate 13*b* project upward and downward from the upper and lower faces of the flange parts 11*a* and 11*b* of the beam 9*b*, respectively. The height of the end plate 13*b* is shorter than the height of the end plate 13*a*.

A pair of the outer diaphragms 3*b* and 3*c* is connected to the parts of the column 5, to which the beam 9*b* is connected. The outer diaphragm 3*c* has the same shape and structure as the outer diaphragms 3*a* or 3*b*. Similarly as the outer diaphragms 3*a* and 3*b*, the outer diaphragm 3*c* is connected to the outer face 4 of the column 5. The outer diaphragms 3*b* and 3*c* are provided to the column 5 at different heights H with a predetermined interval. In the example shown in the drawing, the outer diaphragm 3*c* is connected at a position lower than the outer diaphragm 3*a*. The positional relation in the height direction of the outer diaphragms 3*a*, 3*b*, and 3*c* is not limited to the example shown in the drawing. For example, although the lower end positions of the beam 9*a* and 9*b* (the height of the flange part 11*b*) are aligned in the example, the upper end position (the height of the flange part 11*a*) may be aligned. Alternatively, the heights of the upper and lower ends of the beams 9*a* may be different from the heights of the upper and lower ends of the beams 9*b*, respectively On the projecting parts of the end plate 13*b*, the bolt holes 17 are formed at the positions corresponding to the female screws 15 of the outer diaphragms 3*b* and 3*c*. The end plate 13*b* is connected to the outer diaphragms 3*b* and 3*c* with the bolts 7 that are in the direction parallel to the longitudinal direction of the beam 9*b*.

In the present embodiment, the outer diaphragms 3*a*, 3*b*, and 3*c* are divided into four sections in the perimeter direction, and thus it is required that the outer diaphragms 3*a*, 3*b*, and 3*c* are arranged only at the connection parts of the beams 9*a* and 9*b* (the end plates 13*a* and 13*b*). Thus, if the beams 9*a* and 9*b* are connected only in two directions as shown in the drawing, each of the outer diaphragms 3*a* and 3*c* is necessary for only half the perimeter of the column 5. As above, in the present embodiment, it is possible to adapt for the beams 9*a* and 9*b* having different heights.

Figure 12:
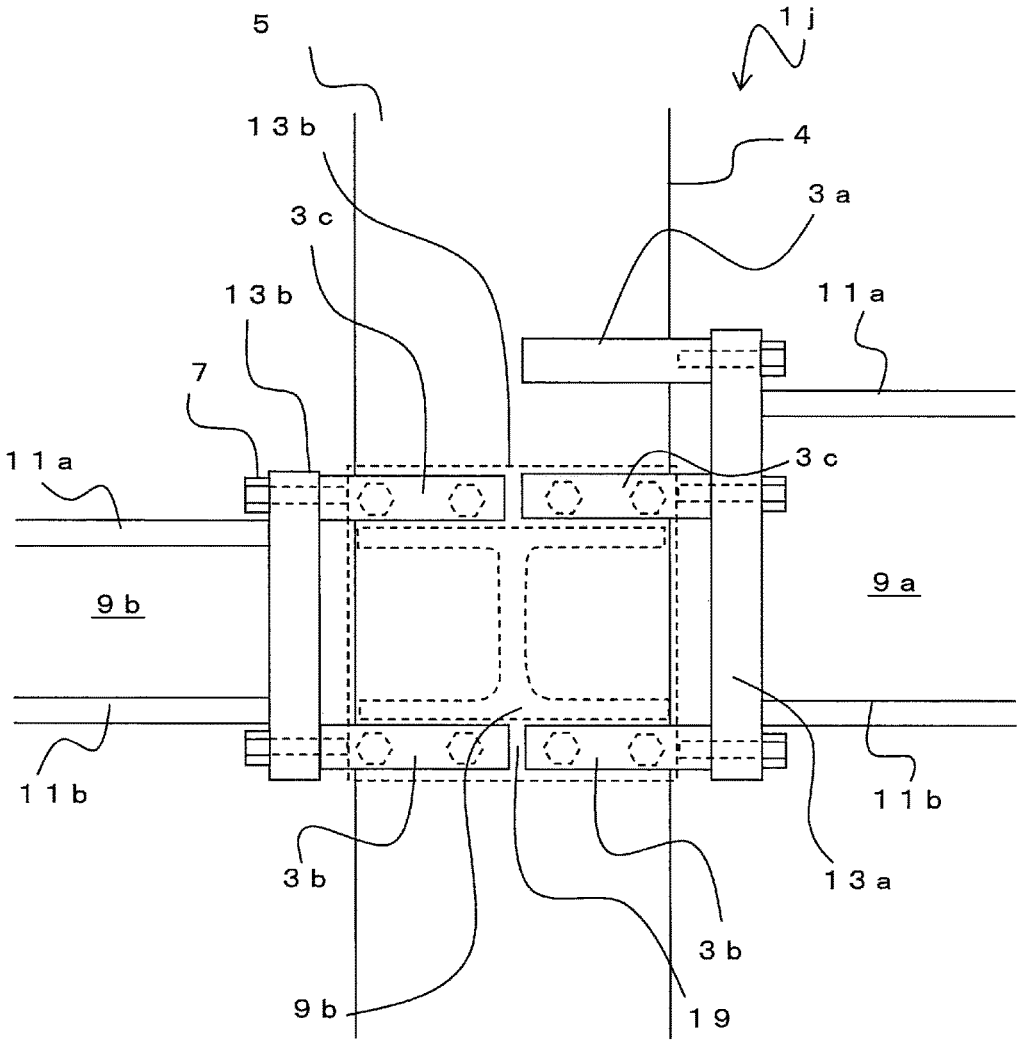
FIG. 12 is a side view showing a connection structure 1*j* of a column and a beam.

Also, FIG. 12 is a side view showing a connection structure 1*j* of a column and a beam. The connection structure 1*j* of a column and a beam has a further beam 9*b* that is connected to the connection structure 1*i* of a column and a beam in a direction orthogonal to the paper surface.

Also in the present embodiment, the outer diaphragms 3*a*, 3*b*, and 3*c* are divided into four sections in the perimeter direction, and thus it is required that the outer diaphragms 3*a*, 3*b*, and 3*c* are arranged only at the connection parts with the beams 9*a* and 9*b* (the end plates 13*a* and 13*b*). For example, if the beam 9*b* is connected to the back side of the example shown in the drawing (i.e. the beams 9*b* are connected in three directions and the beam 9*a* is connected in the remaining one direction), the outer diaphragms 3*b* and 3*c* are required to be connected over the whole perimeter whereas the outer diaphragm 3*a* needs to cover only half of the perimeter.

In this case, the end plate 13*a* that is to be connected with the beam 9*a* may be further connected with the outer diaphragm 3*c*. That is, the bolt holes 17 are provided on the parts of the end plate 13*a* that correspond to the female screws 15 of the outer diaphragm 3*c*, and then the bolts 7 can connect the end plate 13*a* to the outer diaphragm 3*c* within the area in which the bolts 7 do not interfere with the web. This enables to increase the number of bolts 7 for the tall beam 9*a*, improving the connection strength.

According to the fifth embodiment, the same effects as in the first embodiment can be obtained. In addition, the beams 9*a* and 9*b* having different heights can be efficiently connected to the column 5. The arrangement of the beams 9*a* and 9*b* that are to be connected is not limited to the example shown in the drawings. The beam 9*b* may be connected in one direction, or the beams 9*a* and 9*b* may be arranged in two directions crossing at right angles to each other.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

Figure 13:
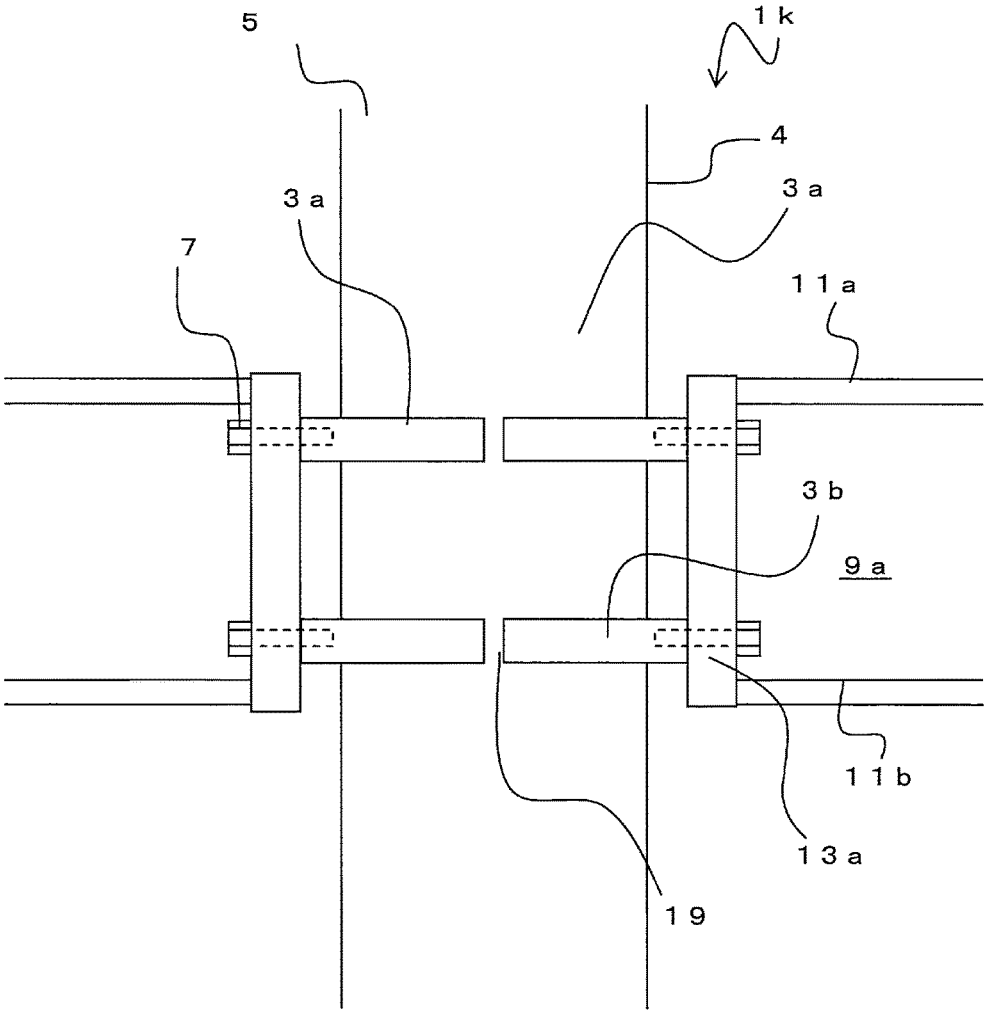
FIG. 13 is a side view showing a connection structure 1*k* of a column and a beam.

For example, if the connection strength between the outer diaphragms 3*a* and 3*b* and the end plate 13*a* is sufficient, the outer diaphragms 3*a* and 3*b* can be connected with the end plate 13*a* only at the lower part of the flange part 11*a* and the upper part of the flange part 11*b* by the bolts 7 as in a connection structure 1*k* of a column and a beam shown in FIG. 13. That is, the end plate 13*a* is not fixed by the bolts 7 at the positions projecting upward and downward from both the flange faces of the beam 9*a* but are fixed by the bolts 7 inside the two flange faces. This enables to decrease the height of the end plate 13*a*.

Needless to say, any of the embodiments can be combined with each other.

DESCRIPTION OF NOTATIONS

1, 1*a*, 1*b*, 1*c*, 1*d*, 1*e*, 1*f*, 1*g*, 1*h*, 1*i*, 1*j*, 1*k* . . . connection structure of a column and a beam

3*a*, 3*b*, 3*c* . . . outer diaphragm

4 . . . outer face

5 . . . column

7 . . . bolt

9*a*, 9*b* . . . beam
11*a*, 11*b* . . . flange part
13*a*, 13*b* . . . end-plate
15 . . . female screw
17 . . . bolt hole
19 . . . gap
21 . . . Cutout
H . . . different heights

What is claimed is:

1. A connection structure for a column and a beam comprising:

outer diaphragms that are connected to different vertical heights of outer faces of the column relative to one another; and a first beam of which an end face is connected with a first end plate, wherein:

female screws are formed on the outer diaphragms in a direction so as to be put between the first end plate and the column;

bolt holes are formed on the first end plate at positions that correspond to the female screws on the outer diaphragms;

bolts in a direction parallel to a longitudinal direction of the first beam connect the first end plate with the outer diaphragms; and each outer diaphragm is divided at the substantially center of the width direction of a pair of opposing faces of the column so as to be divided into two sections in a perimeter direction, each of which is provided in a bending U-shape, and each of the divided sections of the outer diaphragms is connected to three outer faces of the column.

2. The connection structure for a column and a beam according to claim 1, wherein:

divided sections of the outer diaphragms are connected to the column with gaps between the sections.

3. The connection structure for a column and a beam according to claim 1, further comprising:

a second beam, which has a different height from the first beam, connected to the column in a direction different from the direction of the first beam, wherein:

a second end plate is connected to an end face of the second beam;

the height of the second end plate is taller than the height of the second beam, both end parts of the second end plate project upward and downward from both flange faces of the second beam, and bolt holes are formed on the projecting parts of the second end plate at positions that correspond to the female screws on the outer diaphragms; and bolts in a direction parallel to a longitudinal direction of the second beam connect the second end plate with the outer diaphragms.

4. The connection structure for a column and a beam according to claim 1, wherein:

the height of the first end plate is taller than the height of the first beam, both end parts of the first end plate project upward and downward from both flange faces of the first beam, and the bolt holes are formed on the projecting parts of the first end plate.

5. The connection structure for a column and a beam according to claim 1, wherein:

thickness of each outer diaphragm is 1.5 times or more as large as thickness of the end plate in a plan view; and a cutout is formed in a plan view at each corner part of outer faces opposite to inner faces, which are connected to the column, in each of the divided sections of the outer diaphragms where the cutout of each of the divided sections of the outer diaphragms does not touch an end plate of a beam.

6. A method for connecting a column and a beam using outer diaphragms, each of which being divided at the substantially center of the width direction of a pair of opposing faces of the column so as to be divided into two sections in a perimeter direction, each of the sections being provided in a bending U-shape, and a beam of which an end face is connected with an end plate in advance, the method comprising:

forming female screws on the outer diaphragms in a direction so as to be put between the first end plate and the column;

making the height of the end plate taller than the height of the beam and both end parts of the end plate project upward and downward from both flange faces of the beam, and forming bolt holes on the projecting parts of the end plate at positions that correspond to the female screws on the outer diaphragms;

connecting the outer diaphragms to different vertical heights of outer faces of the column relative to one another such that each of the divided sections of each outer diaphragm is connected to three outer faces of the column;

inserting bolts into the bolt holes and the female screws in a direction parallel to a longitudinal direction of the beam to connect the end plate and the outer diaphragms.

7. A connection structure for a column and a beam comprising:

outer diaphragms that are connected to different vertical heights of outer faces of the column relative to one another; and a first beam of which an end face is connected with a first end plate, wherein:

female screws are formed on the outer diaphragms in a direction so as to be put between the first end plate and the column;

bolt holes are formed on the first end plate at positions that correspond to the female screws on the outer diaphragms;

bolts in a direction parallel to a longitudinal direction of the first beam connect the first end plate with the outer diaphragms;

thickness of each outer diaphragm is 1.5 times or more as large as thickness of the end plate in a plan view;

each outer diaphragm is divided at the substantially center of the width direction of two pairs of opposing faces of the column so as to be divided into four sections in a perimeter direction, each of which is provided in a bending L-shape, and each of the divided sections of the outer diaphragms is connected to at least two outer faces of the column; and a cutout is formed in a plan view at each corner part of outer faces opposite to inner faces, which are connected to the column, in each of the divided sections of the outer diaphragms where the cutout of each of the divided sections of the outer diaphragms does not touch an end plate of a beam.

8. A connection structure for a column and a beam comprising:

outer diaphragms that are connected to different vertical heights of outer faces of the column relative to one another; and a first beam of which an end face is connected with a first end plate, wherein:

female screws are formed on the outer diaphragms in a direction so as to be put between the first end plate and the column;

bolt holes are formed on the first end plate at positions that correspond to the female screws on the outer diaphragms;

bolts in a direction parallel to a longitudinal direction of the first beam connect the first end plate with the outer diaphragms; and each outer diaphragm is divided at a pair of corner parts facing each other diagonally of the column so as to be divided into two sections in a perimeter direction, each of which is provided in a bending L-shape, and each of the divided sections of the outer diaphragms is connected to two outer faces of the column.

* * * * *